United States Patent [19]

Cheng et al.

[11] Patent Number: 4,540,289

[45] Date of Patent: Sep. 10, 1985

[54] AUTOMATIC STIRRING SYSTEM FOR FILM DEVELOPING

[75] Inventors: Richard M. H. Cheng, Notre Dame de Grace; Rock S. Lee, St. Hubert, both of Canada

[73] Assignee: Canadian Patents and Development Limited, Ottawa, Canada

[21] Appl. No.: 574,407

[22] Filed: Jan. 27, 1984

Related U.S. Application Data

[63] Continuation-in-part of Ser. No. 320,559, Nov. 12, 1981, abandoned.

[51] Int. Cl.[3] ..... G03D 3/04; B01F 13/08

[52] U.S. Cl. ..... 366/274; 74/29; 354/328; 366/278

[58] Field of Search ..... 366/202, 208, 210, 211, 366/237, 243, 273, 274, 278; 354/327, 328, 329, 330; 74/29

[56] References Cited

U.S. PATENT DOCUMENTS

| | | | |
|---|---|---|---|
| 1,377,473 | 5/1921 | Gschwind | 366/278 X |
| 2,104,283 | 1/1938 | Webster | 354/328 X |
| 2,539,884 | 1/1951 | Barth | 354/328 X |
| 2,545,914 | 3/1951 | Boucher | 366/278 |
| 2,970,235 | 1/1961 | Pike | 366/211 X |
| 3,116,913 | 1/1964 | Lane | 354/328 X |
| 4,021,023 | 5/1977 | Berg | 366/211 |
| 4,184,777 | 1/1980 | Brouhard, Jr. | 366/211 |

*Primary Examiner*—Philip R. Coe

*Attorney, Agent, or Firm*—Robert G. Hendry

[57] ABSTRACT

A drive means for a photographic film developing tank and a developing tank for use therewith, including magnetic coupling means connecting an agitator in the tank with the reciprocating-type drive means, such as a rack and pinion, and an electric motor.

3 Claims, 2 Drawing Figures

AUTOMATIC STIRRING SYSTEM FOR FILM DEVELOPING

This is a continuation-in-part of application Ser. No. 06/320,559, filed Nov. 12, 1981, now abandoned.

This invention relates to stirring devices and, more particularly, to an apparatus for agitating photographic film in a developing solution.

Known devices include crank operated developing tanks and rotary motor driven cylindrical tanks disposed either vertically or horizontally.

The disadvantage of the manually operated developing tank is that it is a rather long and tedious task to develop one batch of film. During the developer and fixer reactions, it is very important to ensure fresh chemicals be brought into contact with the film. Otherwise, the film may come out streaked or plagued with other ill-effects which characterize improper development. Consequently, it is common practice to rock or swish the tank randomly (with the lid on) and at regular intervals, about once a minute and for 15 seconds at a time. Alternatively, where an agitator comes with the developing tank, one can turn the agitator clockwise and counterclockwise instead of the more troublesome rocking and swishing maneouvers. It is, therefore, desirable to provide means whereby the photographer can be freed of the chore of agitating the contents of the tank as long as 8 minutes for some type of film development and another 2–4 minutes of fixing, while carefully timing each step of the developing procedure. On the other hand, the motor driven developing tanks do not provide the gentle thorough agitation of the manually stirred tank.

It is therefore an object of the present invention to provide a motor driven agitator within a developing tank.

A further object of the invention is the provision of drive means which duplicate the highly desirable motion of manually cranked agitators.

A still further object is the provision of a film developing tank which can be readily charged with chemicals and thoroughly cleansed after use.

Accordingly, the present invention provides drive means for agitating a liquid chemical container, said drive means comprising a motor in driving engagement with a crank which has a connecting rod, one end of which engages a rack slider, adapted to oscillate a pinion gear which in turn drives a permanent magnet disk, whereby a second similar disk on the agitator in the container will be driven by said first magnetic disk.

Figure 1:
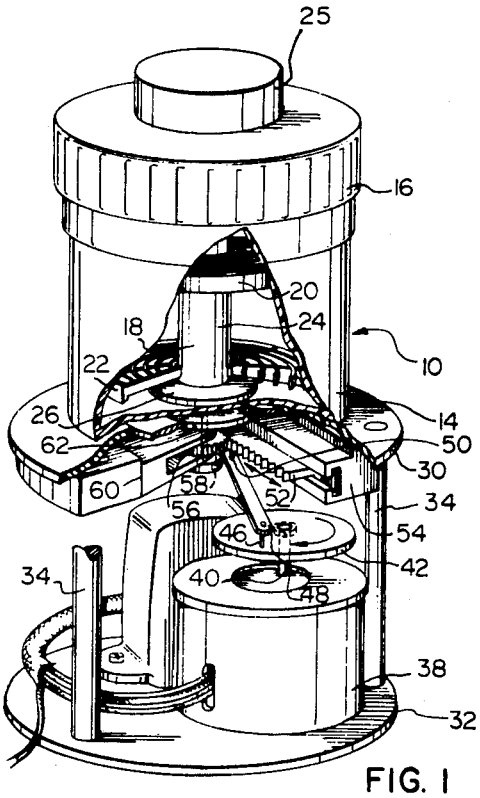
Figure 2:
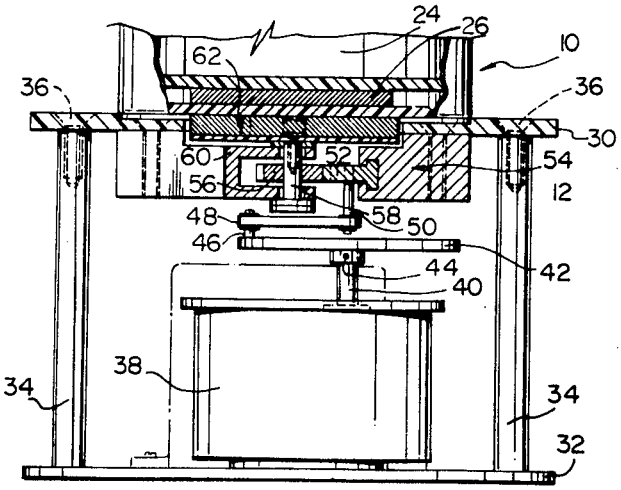

In the accompanying drawings, which illustrate embodiments of this invention:

FIG. 1 is a cut-away perspective view of the drive means and film developing tank; and FIG. 2 is a side elevational view of the drive means and a portion of the film developing tank.

Referring now in detail to the drawings, a film developing tank is shown generally at 10 in FIGS. 1 and 2, and the drive means therefor is shown generally at 12.

The tank 10 comprises a cylindrical body 14 having a screw on lid 16 to permit access to the interior of the body 14 during loading and unloading. An agitator 18, mounted for rotary motion within the tank 10, has upper and lower perforated disks 20 and 22 carried by a central hollow shaft 24. A centrally located aperture (not shown) in the lid 16 communicates with the interior of the hollow shaft 24 to permit chemicals to be added or removed without light entering the tank 10. A liquid-tight cap 25 covers the aperture in the lid 16 to prevent spill-out of chemicals in the tank 10 should it be necessary to invert the tank 10 to agitate its contents. A disk 26 of permanent magnet material, such as barium and iron oxide, having a centrally located aperture, is carried by the hollow shaft 24, and secured thereto as by a friction fitting. The disk 26 is encapsulated in plastic to prevent interaction with the developing chemicals.

The drive means 12 comprises upper and lower disks 30 and 32 spaced apart by three posts 34 (two of which are shown in FIGS. 1 and 2) and secured thereto by screws 36. Suitable drive means, such as a low speed DC motor 38, is secured to the disk 32, not shown explicitly. The motor 38 is mounted with its shaft 40 extending upward. The shaft 40 carries a crank 42 secured thereto by a set screw 44. A stub shaft 46, mounted near the periphery of the crank 42, extends through one end of a connecting rod 48. The other end of the connecting rod 48 has a stub shaft 50 which connects the connecting rod 48 to a T-shaped rack slider 52 slideably mounted in a T-shaped groove in a block 54 secured to the underside of the upper disk 30. A pinion gear 56, meshing with the rack slider 52, is carried by a shaft 58 rotatably mounted in a support 60 secured to the underside of the upper disk 30. The shaft 58 extends through the upper disk 30 and through a disk 62 of permanent magnet material. The pinion gear 56, the shaft 58 and the magnetic disk are all secured together for movement imparted by the motor through the crank 42 connecting rod 48 and rack slider 52.

The drive shaft 40 preferably rotates at a speed of about 6 rpm and is subject to change according to the suitable gear ratio design.

It will be appreciated that the disk magnets 62 and 26 of the tank 10 and drive means 12 are arranged so that there will be magnetic attraction between the disks 62 and 26 to provide a magnetic coupling between the drive means and the agitator shaft 24.

A number of well known mechanisms may be substituted for the slider-crank mechanism described above. Mechanism such as four-bar-linkage mechansim includes a crank and rocker wherein the input crank rotates continuously while the output rocker can only oscillate. Other techniques include the use of an electromechanical servomotor control adapted to change the speed and direction of rotation of the motor to provide the desired oscillating motion. Furthermore, if desired, a timer, and timing indicator, may also be incorporated in the electrical circuit to automatically control the motor 38 when each phase of the developing process has been completed.

We claim:

1. An apparatus for developing photographic film comprising a container for carrying a photographic film developer solution and photographic film to be developed, a detachable screw cap on said container, an agitator within said container for agitating said developer solution, said agitator comprising a central shaft, an upper and a lower perforated disk for receiving and holding photographic film to be developed each fixedly secured to said shaft to thereby move with said shaft, a first magnetic disk encapsulated in plastic fixedly secured to said shaft whereby said shaft moves when said first magnetic disk moves, and drive means for imparting motion to said first magnetic disk, said drive means including housing means having an upper and lower support, a motor having a drive shaft positioned by said lower support of said housing means, a circular crank coupled to said motor drive shaft, a connecting rod having a first and second end secured at said first end to said crank near the periphery thereof, a block having a groove therein secured to said upper support of said housing means, a rack slider disposed in said groove in said block for slidable movement therein, said rack slider being secured to said second end of said connecting rod, a pinion support secured to said upper support of said housing means, a pinion gear carried by a shaft rotatably mounted in said pinon support, said pinion gear being in meshing engagement with said rack slider, second magnetic means secured to said shaft carrying said pinion gear thereby contributing movement to said second magnetic means based on the movement of pinion gear and rack slider, said first magnetic means and second magnetic means being positioned whereby motion of said second magnetic means will cause corresponding motion to said first magnetic means.

2. The apparatus of claim 1 wherein said upper and lower housing supports are disks spaced apart with a plurality of posts.

3. The apparatus of claim 1 wherein said central shaft of said agitator is hollow and said screw cap includes means for the addition of a liquid through said cap into said hollow central shaft.

* * * * *